US008303032B1

(12) United States Patent
Platta

(10) Patent No.: US 8,303,032 B1
(45) Date of Patent: Nov. 6, 2012

(54) PORTABLE COLLAPSIBLE CHAIR AND SLING

(76) Inventor: Bruce K. Platta, Grafton, WI (US)

( * ) Notice: Subject to any disclaimer, the term of this patent is extended or adjusted under 35 U.S.C. 154(b) by 0 days.

(21) Appl. No.: 13/049,603

(22) Filed: Mar. 16, 2011

(51) Int. Cl.

| | |
|---|---|
| ***A47C 1/00*** | (2006.01) |
| ***A47C 4/28*** | (2006.01) |
| ***A47C 31/00*** | (2006.01) |
| ***A47C 7/62*** | (2006.01) |

(52) U.S. Cl. ..... 297/4; 297/45; 297/183.5; 297/188.14

(58) Field of Classification Search ..... 297/45, 297/17, 183, 5, 16.1, 188.14, 4, 42; 224/155, 224/101

See application file for complete search history.

(56) References Cited

U.S. PATENT DOCUMENTS

| | | | | |
|---|---|---|---|---|
| 2,820,509 | A * | 1/1958 | Moreland | 297/56 |
| 4,266,748 | A * | 5/1981 | Dalton | 248/425 |
| 4,522,444 | A * | 6/1985 | Pollock | 297/239 |
| D290,557 | S | 6/1987 | Salvati et al. | |
| 4,676,548 | A * | 6/1987 | Bradbury | 297/129 |
| 5,409,291 | A * | 4/1995 | Lamb et al. | 297/129 |
| 5,501,505 | A * | 3/1996 | Jablonski | 297/4 |
| 5,544,793 | A * | 8/1996 | Harrop | 224/645 |
| 5,582,458 | A * | 12/1996 | Wildt | 297/184.15 |
| 5,588,696 | A * | 12/1996 | Jay et al. | 297/129 |
| 5,733,000 | A * | 3/1998 | Stump | 297/188.06 |
| 6,045,177 | A * | 4/2000 | Grace | 297/45 |
| 6,217,113 | B1 | 4/2001 | Knatz | |
| 6,547,324 | B1 | 4/2003 | Ammann, Jr. | |
| 6,623,072 | B1 * | 9/2003 | Mellace | 297/217.4 |
| 6,942,289 | B2 * | 9/2005 | McBride | 297/188.14 |
| 7,628,450 | B2 | 12/2009 | Castagnola et al. | |
| 7,644,981 | B2 | 1/2010 | Hensley | |
| 7,717,503 | B1 * | 5/2010 | Watson | 297/45 |
| 7,845,720 | B2 * | 12/2010 | Randall | 297/188.04 |
| 8,061,766 | B2 * | 11/2011 | Miller | 297/60 |
| 8,091,962 | B2 * | 1/2012 | Quinn | 297/184.16 |
| 2004/0222678 | A1 | 11/2004 | Hansen | |

* cited by examiner

*Primary Examiner* — Milton Nelson, Jr.

(57) ABSTRACT

A portable collapsible chair and sling is provided for facilitating carrying of a collapsible chair using a sling attached directly to the collapsible chair. The assembly includes a frame having a pair of front legs, a pair of rear legs, and a plurality of scissor arms coupling the front legs to the rear legs. Thus, the frame is adjustable between an expanded position and a collapsed position. A sheet of material is coupled to the frame and includes a seat portion extending between the front legs and the rear legs of the frame. A sling is coupled to the frame including a first end coupled to a lower end of one of the rear legs and a second end coupled to a top of the frame.

12 Claims, 6 Drawing Sheets

PORTABLE COLLAPSIBLE CHAIR AND SLING

BACKGROUND OF THE DISCLOSURE

Field of the Disclosure

The disclosure relates to portable chair devices and more particularly pertains to a new portable chair device for facilitating carrying of the device using a sling attached directly to a collapsible chair.

SUMMARY OF THE DISCLOSURE

An embodiment of the disclosure meets the needs presented above by generally comprising a frame having a pair of front legs, a pair of rear legs, and a plurality of scissor arms coupling the front legs to the rear legs. Thus, the frame is adjustable between an expanded position and a collapsed position. A sheet of material is coupled to the frame and includes a seat portion extending between the front legs and the rear legs of the frame. A sling is coupled to the frame including a first end coupled to a lower end of one of the rear legs and a second end coupled to a top of the frame.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
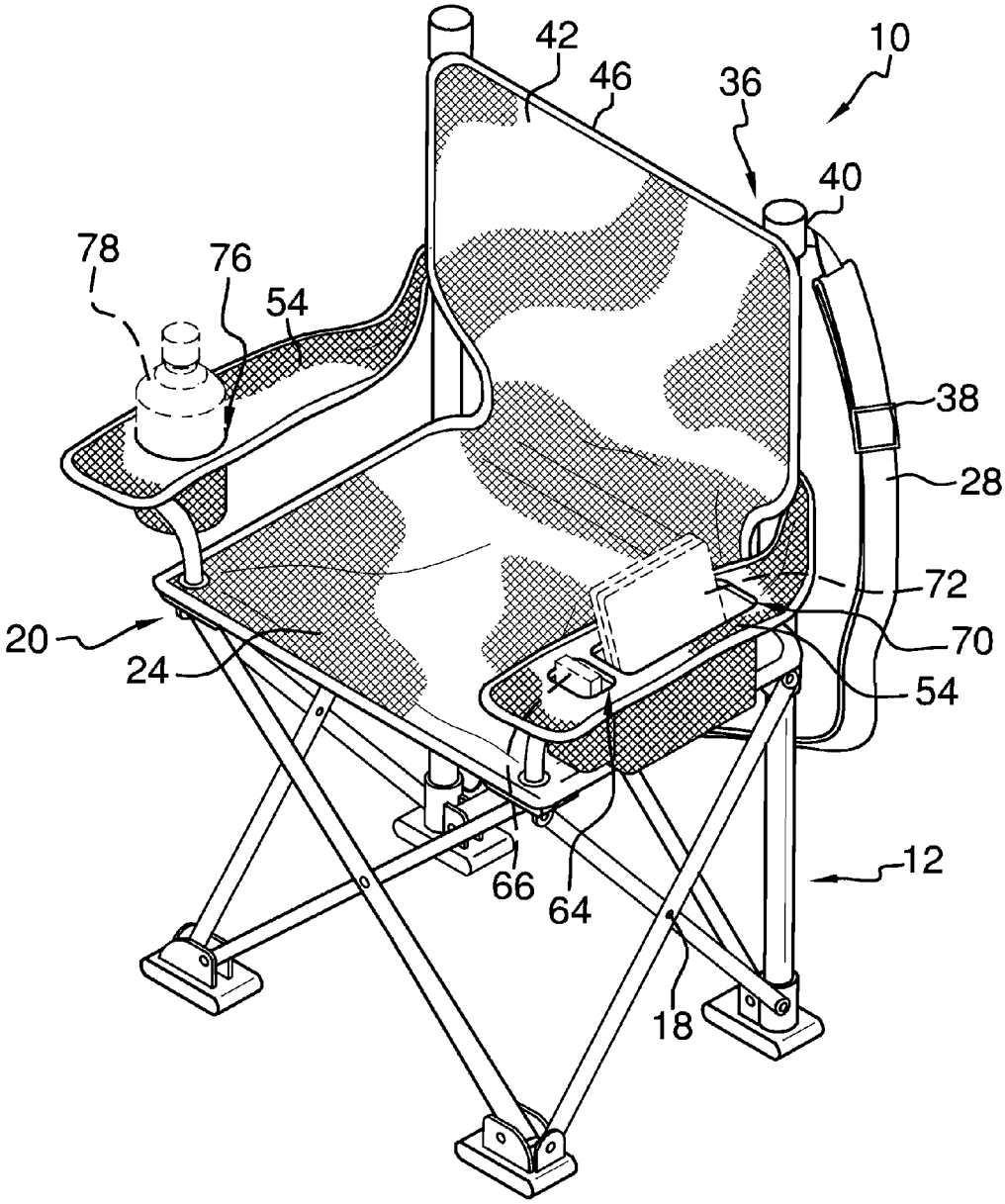
FIG. 1 is a top front side perspective view of a portable collapsible chair and sling according to an embodiment of the disclosure.
Figure 2:
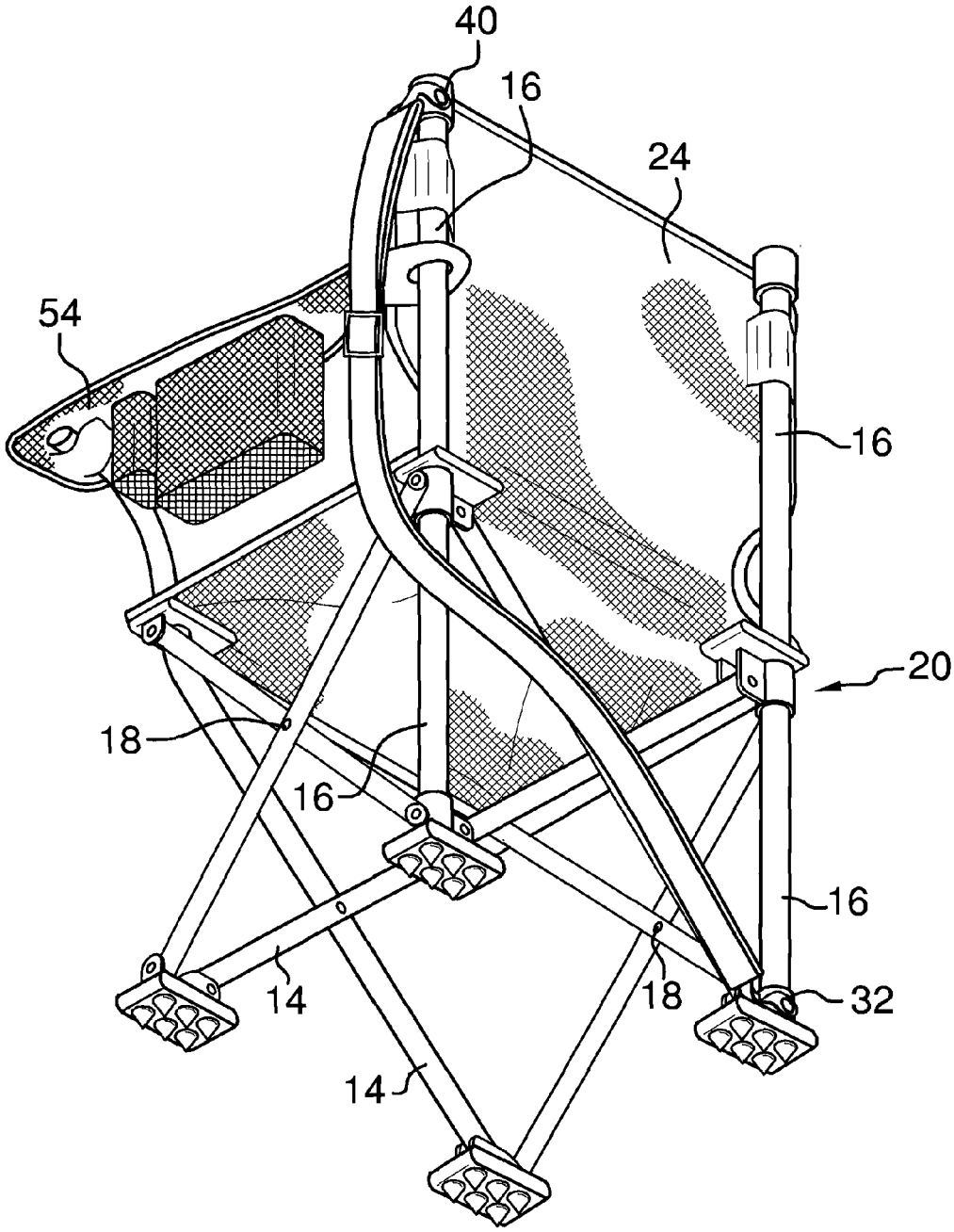
FIG. 2 is a bottom rear side perspective view of an embodiment of the disclosure.
Figure 3:
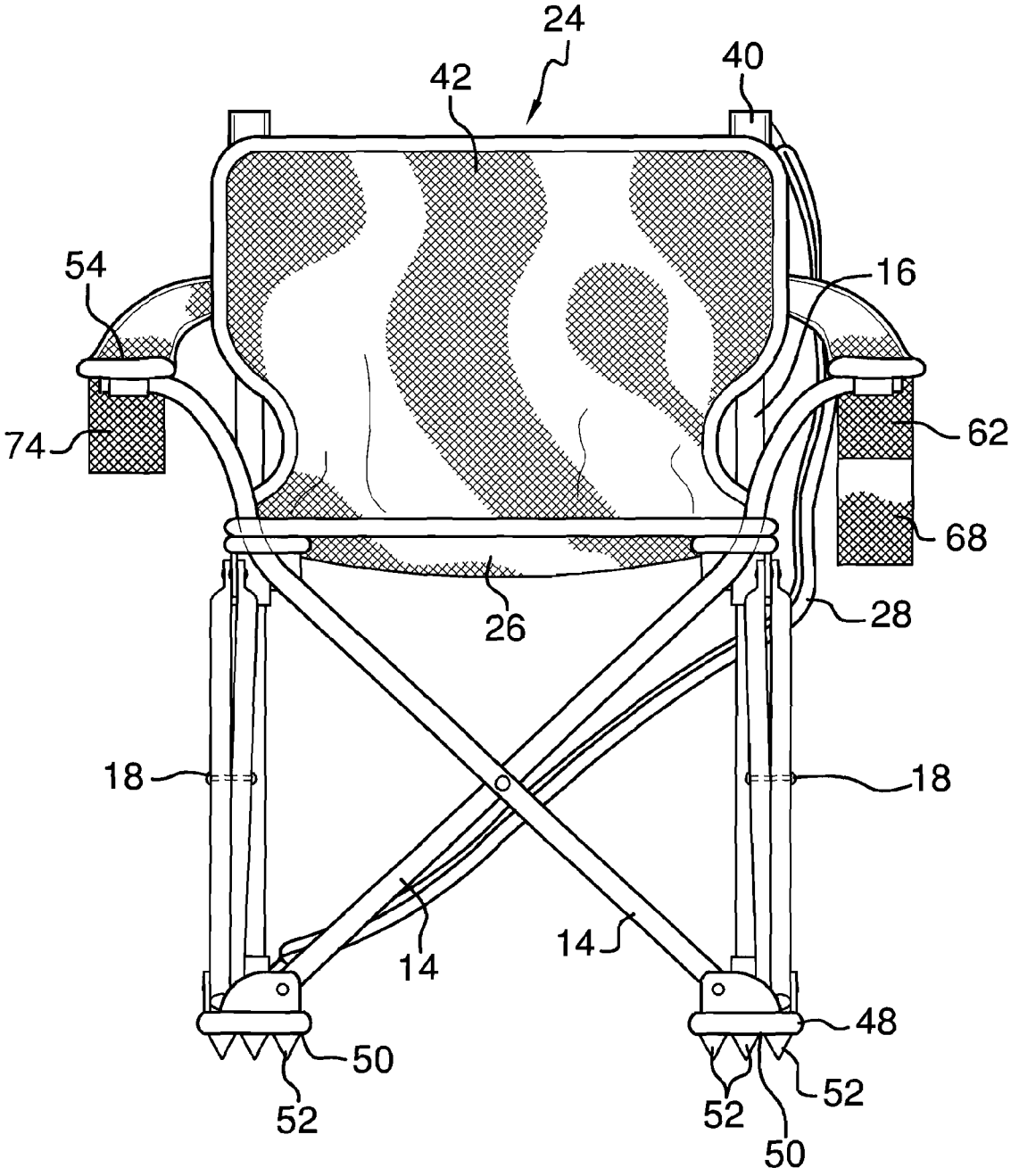
FIG. 3 is a front view of an embodiment of the disclosure.
Figure 4:
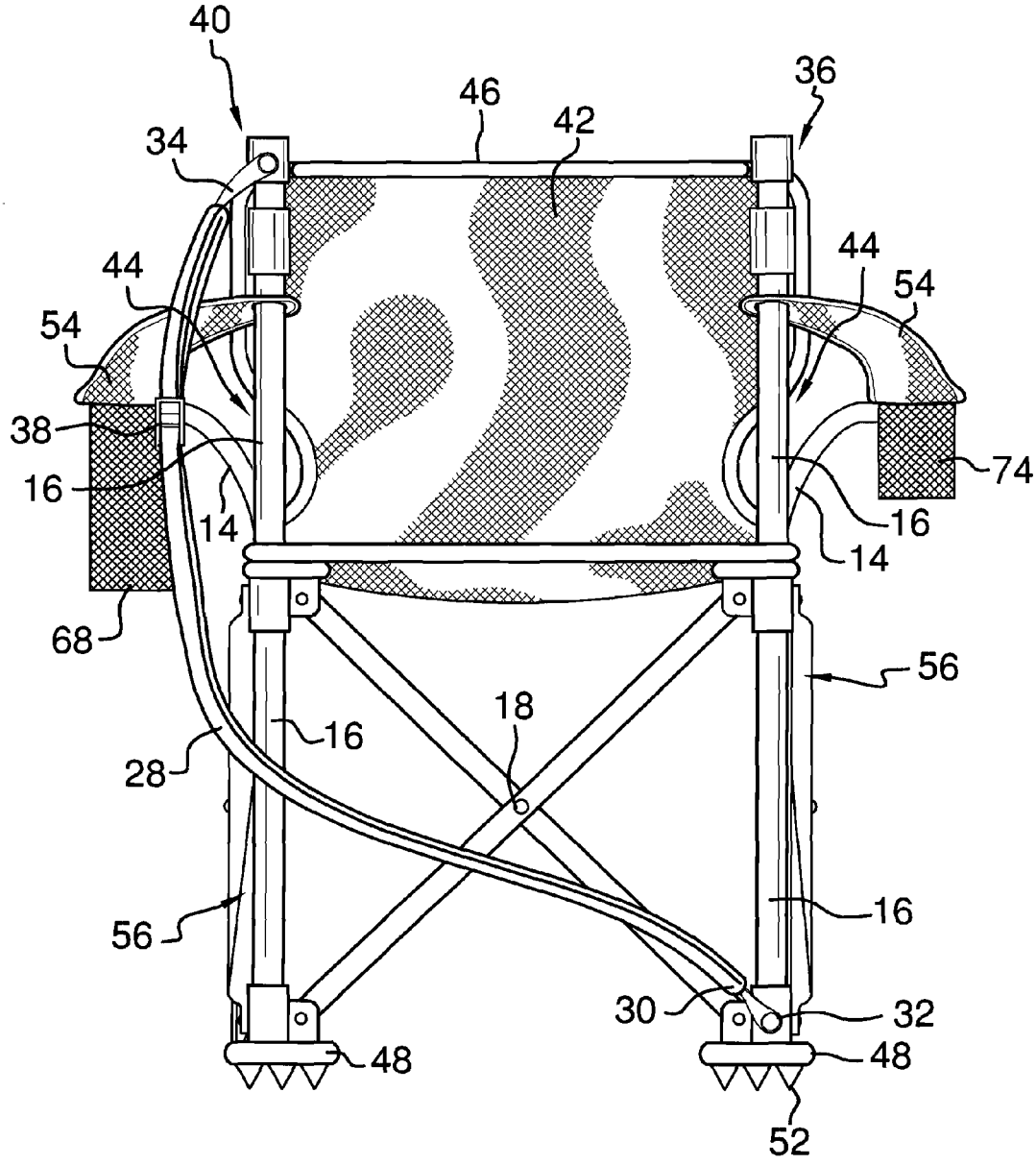
FIG. 4 is a rear view of an embodiment of the disclosure.
Figure 5:
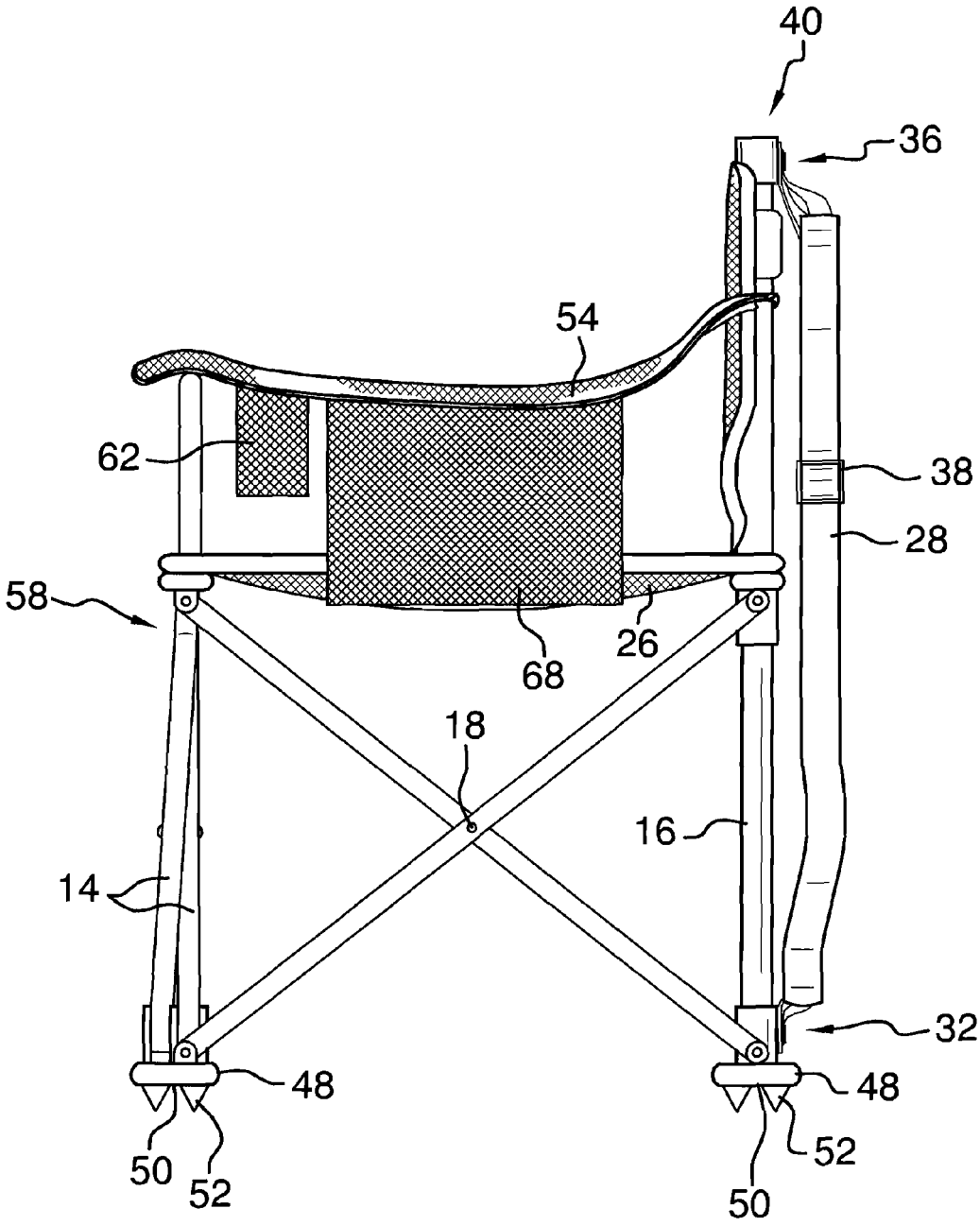
FIG. 5 is a side view of an embodiment of the disclosure.
Figure 6:
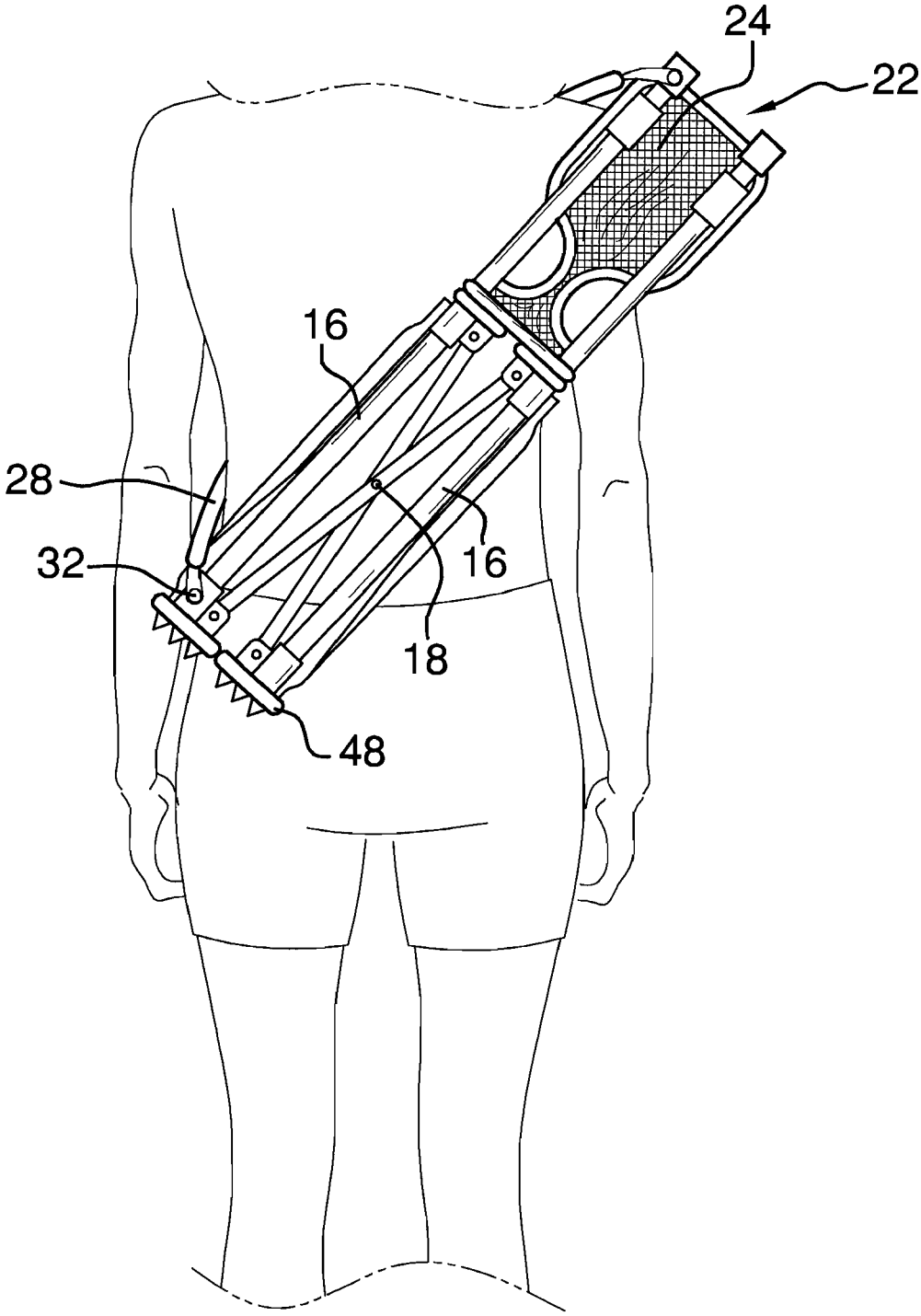
FIG. 6 is a rear view of an embodiment of the disclosure in a collapsed position.

With reference now to the drawings, and in particular to FIGS. 1 through 6 thereof, a new portable chair device embodying the principles and concepts of an embodiment of the disclosure and generally designated by the reference numeral 10 will be described.

As best illustrated in FIGS. 1 through 6, the portable collapsible chair and sling 10 generally comprises a frame 12 having a pair of front legs 14, a pair of rear legs 16, and a plurality of scissor arms 18 coupling the front legs 14 to the rear legs 16. Thus, the frame 12 is adjustable between an expanded position 20 and a collapsed position 22 as is known in currently available collapsible chair structures. The collapsed position 22 is characterized by the frame 12 taking on a compact elongated shape. A sheet of lightweight mesh material 24 is coupled to the frame 12. The material 24 includes a seat portion 26 extending between the front legs 14 and the rear legs 16. A sling 28 is coupled to the frame 12. The sling 28 includes a first end 30 coupled to a lower end 32 of one of the rear legs 16. The sling includes a second end 34 coupled to a top 36 of the frame. The sling 28 also includes an adjustable length by manipulation of a slide buckle 38. Each rear leg 16 may be oriented to have a greater vertical length compared to the front legs 14 when the frame 12 is in the expanded position 20. The material 24 may have a seat back portion 42 extending between upper portions 44 of the rear legs 16. The first end 30 of the sling 28 may be coupled to the lower end 32 of one of the rear legs 16 and the second end 34 of the sling 28 may be coupled to either a top 40 of another one of the rear legs 16 or proximate the top edge 46 of the seat back portion 42 adjacent to the other rear leg 16. Thus, the sling 28 extends diagonally across both a width and a height of the frame 12 in similar fashion to an arrow quiver.

A plurality of feet 48 is provided and may be utilized to interconnect the rear legs 16, front legs 14, and the scissor arms 18. The feet 48 are coupled to each of the rear legs 16 and each of the front legs 14. Each of the feet 48 has a planar bottom surface 50. A plurality of spikes 52 may extend from the bottom surface 50 of each of the feet 48 to enhance stable placement of the feet 48 on a supporting ground surface.

The material 24 may integrally include a pair of arm sheets 54 or the arm sheets 54 may be formed by additional portions of material coupled to extend from the seat back portion 42. Each arm sheet 54 extends across an associated side 56 of the frame 12 between a front 58 of the frame 12 and a back 60 of the frame 12. A phone pocket 62 may be positioned in one of the arm sheets 54. The phone pocket 62 includes a rectangular transverse cross-sectional shape 64. Thus, the phone pocket 62 is configured for holding a wireless phone 66. A computer pocket 68 may be positioned in one of the arm sheets 54 adjacent to the phone pocket 62. The computer pocket 68 includes an elongated rectangular cross-sectional shape 70. Thus, the computer pocket 68 is configured for holding a laptop computer 72. A beverage pocket 74 may be positioned in one of the arm sheets 54, preferably opposite the phone pocket 62 and computer pocket 68 to prevent liquid spills onto either the phone 66 or computer 72. The beverage pocket 74 may include a circular cross-sectional shape 76 whereby the beverage pocket 74 is configured for holding a beverage container 78.

Both the frame 12 and the material 24 are constructed of materials designed to be very lightweight but strong to support a user in a seated position. The material 24 may also be designed to promote air flow and wick away moisture to generally promote comfort when the user is seated in the chair and sling 10.

In use, the chair and sling 10 may be easily collapsed and transported by positioning the sling 28 over the shoulder and across the body of a user. Thus, the chair and sling 10 may be transported without having to be grasped by the user at all. The chair and sling 10 is also capable of use without a cover and thus obviates time-consuming positioning of the assembly into the cover and removal from the cover for use. The chair and sling 10 may be carried and utilized to support the user in a seated position during various activities including but not limited to sporting events, miniature golf, shopping, or any other activity requiring or permitting alternating periods of movement and rest.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A chair assembly comprising:

a frame having a pair of front legs, a pair of rear legs, and a plurality of scissor arms coupling said front legs to said rear legs whereby said frame is adjustable between an expanded position and a collapsed position;

a sheet of material coupled to said frame, said material having a seat portion extending between said front legs and said rear legs; and a sling coupled to said frame, said sling having a first end coupled to a lower end of one of said rear legs, said sling having a second end coupled to a top of said frame at a top of a second one of said rear legs whereby said sling extends diagonally across said frame.

2. The assembly of claim 1, wherein said sling has an adjustable length.

3. The assembly of claim 1, wherein said first end of said sling is coupled to said lower end of one of said rear legs and said second end of said sling is coupled to said top of said second one of said rear legs whereby said sling extends across a width and a height of said frame.

4. The assembly of claim 1, further including a plurality of feet, said feet being coupled to each of said rear legs and each of said front legs.

5. The assembly of claim 4, wherein each of said feet has a planar bottom surface.

6. The assembly of claim 5, further including a plurality of spikes extending from said bottom surface of each of said feet.

7. The assembly of claim 1, wherein said material is a lightweight mesh.

8. The assembly of claim 1, further including a pair of arm sheets, each arm sheet extending across an associated side of said frame between a front of said frame and a back of said frame.

9. The assembly of claim 8, further including a phone pocket positioned in one of said arm sheets, said phone pocket having a rectangular transverse cross-sectional shape whereby said phone pocket is configured for holding a wireless phone.

10. The assembly of claim 8, further including a computer pocket positioned in one of said arm sheets, said computer pocket having an elongated rectangular cross-sectional shape whereby said computer pocket is configured for holding a laptop computer.

11. The assembly of claim 8, further including a beverage pocket positioned in one of said arm sheets, said beverage pocket having a circular cross-sectional shape whereby said beverage pocket is configured for holding a beverage container.

12. A chair assembly comprising:

a frame having a pair of front legs, a pair of rear legs, and a plurality of scissor arms coupling said front legs to said rear legs whereby said frame is adjustable between an expanded position and a collapsed position;

a sheet of lightweight mesh material coupled to said frame, said material having a seat portion extending between said front legs and said rear legs;

a sling coupled to said frame, said sling having a first end coupled to a lower end of one of said rear legs, said sling having a second end coupled to a top of said frame, said sling having an adjustable length, said first end of said sling being coupled to said lower end of one of said rear legs and said second end of said sling being coupled to a top of another one of said rear legs whereby said sling extends across a width and a height of said frame;

a plurality of feet, said feet being coupled to each of said rear legs and each of said front legs, wherein each of said feet has a planar bottom surface;

a plurality of spikes extending from said bottom surface of each of said feet;

a pair of arm sheets, each arm sheet extending across an associated side of said frame between a front of said frame and a back of said frame;

a phone pocket positioned in one of said arm sheets, said phone pocket having a rectangular transverse cross-sectional shape whereby said phone pocket is configured for holding a wireless phone;

a computer pocket positioned in one of said arm sheets, said computer pocket having an elongated rectangular cross-sectional shape whereby said computer pocket is configured for holding a laptop computer; and a beverage pocket positioned in one of said arm sheets, said beverage pocket having a circular cross-sectional shape whereby said beverage pocket is configured for holding a beverage container.

* * * * *